US008896238B2

(12) United States Patent
Abs

(10) Patent No.: US 8,896,238 B2
(45) Date of Patent: Nov. 25, 2014

(54) DEVICE AND METHOD FOR FAST BEAM CURRENT MODULATION IN A PARTICLE ACCELERATOR

(71) Applicant: Michel Abs, Bossiere (BE)

(72) Inventor: Michel Abs, Bossiere (BE)

(73) Assignee: Ion Beam Applications S.A., Louvain La-Neuve (BE)

( * ) Notice: Subject to any disclaimer, the term of this patent is extended or adjusted under 35 U.S.C. 154(b) by 82 days.

(21) Appl. No.: 13/767,541

(22) Filed: Feb. 14, 2013

(65) Prior Publication Data

US 2013/0162176 A1 Jun. 27, 2013

Related U.S. Application Data

(63) Continuation of application No. 12/740,319, filed as application No. PCT/EP2007/061626 on Oct. 29, 2007, now Pat. No. 8,410,730.

(51) Int. Cl.

| | |
|---|---|
| ***H05H 7/02*** | (2006.01) |
| ***H05H 13/00*** | (2006.01) |
| ***H05H 7/10*** | (2006.01) |

(52) U.S. Cl.

CPC ..... *H05H 7/10* (2013.01); *H05H 13/00* (2013.01); *H05H 7/02* (2013.01)

USPC ..... 315/502

(58) Field of Classification Search

None

See application file for complete search history.

(56) References Cited

U.S. PATENT DOCUMENTS

| | | | | |
|---|---|---|---|---|
| 4,139,777 | A | 2/1979 | Rautenbach | |
| 6,441,569 | B1 * | 8/2002 | Janzow | 315/502 |
| 6,873,123 | B2 | 3/2005 | Marchand et al. | |
| 7,402,963 | B2 | 7/2008 | Sliski et al. | |
| 7,446,490 | B2 * | 11/2008 | Jongen et al. | 315/502 |
| 7,466,085 | B2 | 12/2008 | Nutt | |
| 2006/0164026 | A1 | 7/2006 | Sasaki et al. | |

FOREIGN PATENT DOCUMENTS

| | | | |
|---|---|---|---|
| EP | 1 265 462 | A1 | 12/2002 |
| WO | 00/40064 | A2 | 7/2000 |
| WO | 03/092340 | A1 | 11/2003 |

OTHER PUBLICATIONS

R. Sepulchre, et al., "Pencil Beam Scanning: A Dynamical Approach to Proton Therapy." Jan. 1, 2000, pp. 370-375.

(Continued)

*Primary Examiner* — Crystal L Hammond

(74) *Attorney, Agent, or Firm* — Fitch, Even, Tabin & Flannery LLP

(57) ABSTRACT

The present invention relates to a circular particle accelerator capable of modulating the particle beam current exiting the circular particle accelerator. The circular particle accelerator includes: an ion source for generating the particle beam; Dee electrode and counter-Dee electrode separated from each other by gaps for accelerating the particle beam, the counter-Dee electrode being grounded; a generator capable of applying an alternating high voltage to the Dee electrode, so as it is possible to have an electric field between the gaps; means for measuring the current intensity of the particle beam exiting the circular particle accelerator. It also comprises a regulator capable of modulating the Dee electrodes voltage amplitude ($V_D$) by comparing a given set point ($I_0$) of the current intensity of the particle beam and the measured value of the current intensity ($I'_M$) of the particle beam.

26 Claims, 2 Drawing Sheets

(56) References Cited

OTHER PUBLICATIONS

N.I. Venikov. "Reduction of the Length and Repetition Frequency of the Ion Bunches in a Cyclotron." Plasma Physics-Accelerators-Thermonuclear Research (Journal of Nuclear Energy. Part C) United Kingdom, vol. 4, No. 5, Oct. 1962, pp. 361-364.

International Preliminary Report on Patentability, International Application No. PCT/EP2007/061626, May 4, 2010, 8 pages.

Written Opinion of the Searching Authority, International Application No. PCT/EP2007/061626, Apr. 29, 2010, 7 pages.

* cited by examiner

DEVICE AND METHOD FOR FAST BEAM CURRENT MODULATION IN A PARTICLE ACCELERATOR

CROSS REFERENCE TO RELATED APPLICATION

This application is a continuation of U.S. patent application Ser. No. 12/740,319, now U.S. Pat. No. 8,410,730, filed on Apr. 28, 2010, which is a U.S. national phase application of International Application No. PCT/EP2007/061626, filed Oct. 29, 2007, designating the United States, all of which are incorporated by reference herein in their entireties.

FIELD OF THE INVENTION

The present invention relates to the field of particle accelerators to be used in radiation therapy. More particularly, this invention relates to the regulation of beam current intensity of a circular particle accelerator such as a cyclotron.

STATE OF THE ART

A cyclotron is a re-circulation particle accelerator, which operates under high vacuum and in which charged particles, generated by an ion source, are accelerated in a circular motion. This is achieved by using on one hand a magnetic field which causes the particles, coming from said source, to follow a circular path in a plane perpendicular to said magnetic field, and on the other hand a high-frequency alternating voltage applied to so-called Dee electrodes which impart to particles passing through it an increasing of their energy.

An internal ion source typically comprises a cylindrical arc chamber or ion source body which is grounded and has a heated filament at one end and a floating anti-cathode at the other end. The filament or cathode is biased negatively with respect to the ground. The cathode produces electrons in order to create the electrical discharge, while the anti-cathode is capable of reflecting them repeatedly along the arc chamber axis. The electrons follow the magnetic field lines describing a very small helical path making the electron travel very long from one cathode to the other. A gas (typically a Hydrogen gas or another gas, depending on the particles desired for the particle beam) is injected in the interior of said ion source. The electrons loose part of their energy in the gas during their travel and create ionisation forming consequently a plasma column.

Some cyclotron models are designed with an internal ion source, while others are designed with an external ion source.

In a cyclotron equipped with an internal ion source, the ion source is located within the so-called central region of the cyclotron. Ions generated by said ion source are directly extracted from the ion source body through a slit and pulled out of said slit by a voltage difference applied between the ion source body and an electrode called puller, the latter being biased with a power source at an alternating potential. After extraction from the ion source, ions move through electrodes, typically called Dee's. Cyclotron also comprises: an electromagnet which produces a magnetic field (perpendicular to the direction of particles) for guiding and confining particles in a circular path; and a high frequency power supply which is capable of applying an alternating voltage to said Dee electrodes and therefore rapidly alternating the polarity of the electrical field generated in the gap between said Dee-electrodes. Since the electric field is absent inside the Dee electrodes, particles travelling through Dee electrodes are not affected by the electric field. Thus, if the voltage applied to Dee electrodes is reversed while particles are inside the Dee electrodes, each time particles pass through the gap, they increasingly acquire acceleration following a spiral path by gaining energy. At the end of said spiral path there is an extraction member, such as an electrostatic deflector, which realizes the extraction of the particles from the cyclotron in the form of a particle beam.

In a cyclotron with an external ion source, ions generated by said ion source are first conveyed from the external ion source within said cyclotron and then inflected for being accelerated similarly to the case of cyclotrons with internal source. An advantage of cyclotrons with an external ion source over cyclotrons with an internal ion source consists in that the ion source is easily accessible for maintenance work, with the vacuum condition always kept.

Several beam delivery techniques which are used nowadays in particle therapy, e.g. double scattering or pencil beam scanning, require a fast and as precise as possible modulation of the current intensity of the particle beam produced by the cyclotron.

Currently, such a modulation is achieved by varying the ion source arc current. This may be achieved by changing the cathode voltage or by changing the heating current applied to the cathode filament.

One of the main drawbacks which rises up in known techniques for modulating the current intensity of the particle beam extracted from an ion source consists in that when the arc current is reduced to zero a non zero beam current intensity ("dark current") may be still produced and accelerated by the cyclotron. Even when no gas is introduced in the ion source body, remaining gas contained in the cyclotron may be also ionized by electrons discharged from the source body to the puller and produce the dark current. In addition, when gas is introduced into the source body and the cathode filament is still hot, additional ionization and dark current may be produced.

The intensity of this minimum accelerated beam current is however evidently incompatible with a good treatment, since the complete irradiation field is always fully scanned by the beam. As a consequence, this residual accelerated beam may be dangerous for healthy tissues of a treated patient.

An example of a system which is capable of performing such a beam modulation is described in U.S. Pat. No. 6,873,123 by the Applicant. This system is capable of regulating the current intensity of a particle beam extracted from a cyclotron by varying the arc current of the ion source. This system mainly comprises:

- a comparator (90) which computes a difference $\epsilon$ between a digital signal $I_R$, corresponding to the beam current intensity measured at the exit of the accelerator, and a set-point value $I_C$ of the beam current intensity;
- a Smith predictor (80), which computes a corrected value of the beam current intensity $I_P$ based on said difference $\epsilon$;
- an inverted correspondence table (40) which provides, based on this value $I_P$, a set-point value $I_A$ for the supply of the arc current of the ion source (20).

This system reveals, however, some disadvantages as follows: the modulation of the current intensity of the particle beam extracted from the ion source depends on the relation between the beam current and the arc current. This relation is highly non-linear and depends on many parameters. As a consequence, the inverted correspondence table (40) may provide values of $I_A$ which are not reliable. Furthermore, this system is not capable of overcoming the above-discussed "dark current" drawback.

Accordingly no practical solution has been proposed so far in order to perform a fast beam current modulation which may solve the above-mentioned drawbacks.

AIMS OF THE INVENTION

The present invention aims to provide a device and method which overcomes the problem of the prior art.

In particular the present invention aims to provide a device and method for modulating the particle beam current exiting a particle accelerator.

SUMMARY OF THE INVENTION

According to a first aspect of the present invention, it is provided a circular particle accelerator for generating a particle beam, said circular particle accelerator being capable of modulating the current of the particle beam and comprising:

an ion source for generating said particle beam;

Dee electrode and counter-Dee electrode separated from each other by gaps for accelerating said particle beam, said counter-Dee electrode being grounded;

a generator capable of applying an alternating high voltage to said Dee electrode, so as it is possible to have an electric field between said gaps;

means for measuring the current intensity of said particle beam exiting said circular particle accelerator;

characterized in that it also comprises a regulator capable of modulating (regulating) the Dee electrodes voltage amplitude by comparing a given set point of the current intensity of the particle beam and the measured value of the current intensity of said particle beam.

Preferably, said circular particle accelerator further comprises a collimator for shaving unwanted particles exiting said ion source having orbit radius less than or equal to a given value, this given value corresponding to a threshold value of the Dee electrodes voltage amplitude.

Advantageously, said collimator is located in the central region of said particle accelerator.

More preferably, said circular particle accelerator is arranged so as to stabilize the ion source arc current to a predetermined value during the modulation of the Dee electrodes voltage amplitude.

More advantageously, said regulator is a PID regulator.

According to a preferred embodiment, said circular particle accelerator is a cyclotron provided with an internal ion source.

According to a second preferred embodiment, said circular particle accelerator is a cyclotron provided with an external ion source.

According to a second aspect of the present invention, it is provided a method for modulating the particle beam current exiting a circular particle accelerator, said circular particle accelerator comprising:

an ion source for generating said particle beam;

Dee electrode and counter-Dee electrode separated from each other by gaps for accelerating said particle beam, said counter-Dee electrode being grounded;

a generator capable of applying an alternating high voltage to said Dee electrode, so as it is possible to have an electric field between said gaps;

means for measuring the current intensity of said particle beam exiting said circular particle accelerator;

the method comprising the steps of:

providing a regulator for modulating the Dee electrodes voltage amplitude based on the comparison of a given set-point value of the beam current intensity and said measured value of the current intensity of the particle beam exiting said cyclotron.

Preferably, according to this second aspect, the provided method further comprises the step of providing a collimator for shaving all unwanted particles when the Dee electrodes voltage amplitude is below a threshold value.

More preferably, said collimator is located at the central region of said circular particle accelerator.

DETAILED DESCRIPTION OF PREFERRED EMBODIMENTS OF THE PRESENT INVENTION

The present invention will be now described in details in relation to the appended drawings. However, it is evident that a person skilled in the art may conceive several equivalent embodiments or other ways of executing the present invention. The spirit and the scope of the present invention are therefore limited only by the terms of the claims.

Figure 1:
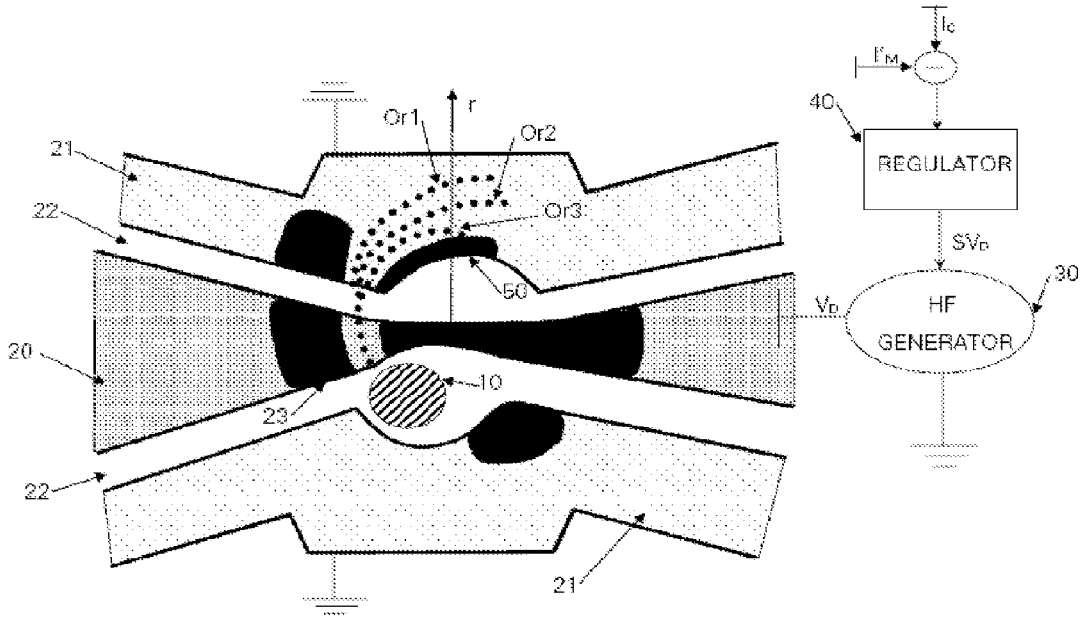
FIG. 1 shows a simplified representation of the central region of a particle accelerator according to the invention.

FIG. 1 shows a simplified representation of the central region of a particle accelerator according to a preferred embodiment of the present invention. The particle accelerator according to this preferred embodiment is a cyclotron. The central region of this cyclotron comprises:

an ion source 10 for generating charged particles, wherein the value of the ion source arc current applied to said ion source is kept fixed to a predetermined value, said ion source comprising an ion source body which is grounded;

an electrode called puller 23 which is physically connected to the Dee electrode;

a Dee electrode 20 connected to a high frequency power generator 30, the latter being capable of applying an alternating high voltage to said Dee electrode 20 and comprising a control input for receiving a set-point value for the amplitude of the high voltage to be provided;

a counter-Dee electrode 21 which is grounded and together with Dee electrode accelerates particles passing through gaps 22;

a regulator 40 for regulating and providing a set-point value for the Dee electrode voltage amplitude;

a collimator 50.

The ions source 10, which is typically located at the centre of the particle accelerator, generates low-energy ions that are pulled out from said ion source by the electric field created between the ion source body and said puller 23. Ions are accelerated to the Dee electrode 20 when crossing the first gap 22 between the Dee electrode 20 and the counter Dee 21 due to the electric field. Since the radius of curvature followed by a particle depends on the amount of energy gained by this particle, particles having difference in phase with respect to alternating Dee voltage gain different amounts of energy and have also, consequently, different orbit radius. The collimator 50 is located within the central region of the cyclotron and it is provided for "shaving" unwanted particles exiting said ion source. Since regulator 40 provides a set-point values of the Dee electrode voltage amplitude to the generator 30, different values of the Dee electrode voltage amplitude determine different values of the electric field and therefore different amounts of energy gained from particles, resulting in different orbit radius. The collimator 50 shaves all orbits having radius less than or equal to a critical radius $r_0$, the latter corresponding to a value of the Dee electrode voltage amplitude which is below a certain threshold value. With reference to FIG. 1, particles belonging to orbits Or1 and Or2 (having orbit radius greater than $r_0$) are not stopped by collimator 50, while particles belonging to obit Or3 (which have an orbit radius less than $r_0$) are stopped by collimator 50.

Figure 1A:
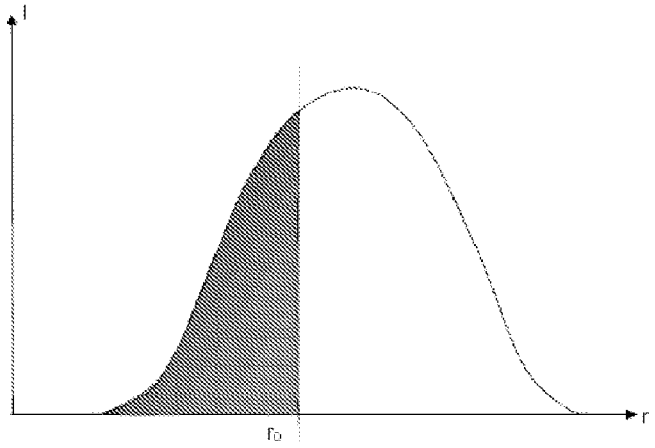
FIG. 1*a* is a simplified chart showing the "shaving" of the particle beam current intensity generated by the particle accelerator of FIG. 1.

FIG. 1*a* represents the beam current intensity I, as a function of the radius r, measured from the central axis of the cyclotron, in the vicinity of collimator 54. Said collimator 50 cuts away the black area of the Gaussian profile of the particle beam depending on the orbit radius r. Therefore, all particles having an orbit radius less than or equal to $r_0$, will be stopped by collimator 50, while all particle having an orbit radius bigger than $r_0$, will not be stopped.

Figure 2:
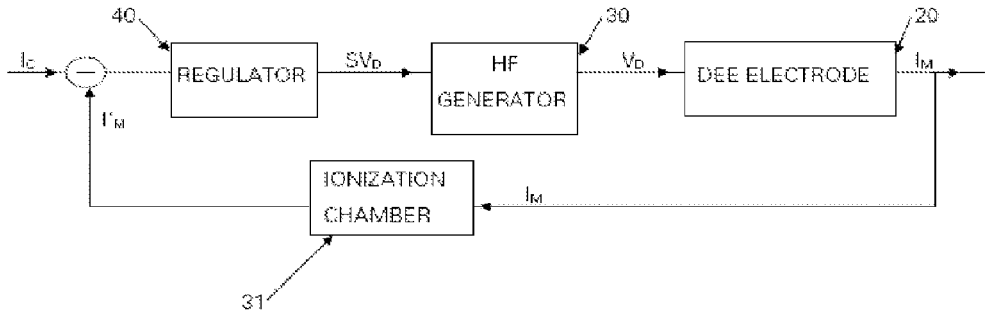
FIG. 2 shows a schematic block diagram of the control system of the particle accelerator of FIG. 1.

FIG. 2 shows a schematic block diagram of control system of the particle accelerator according to the invention. The regulator 40, according to this preferred embodiment of the invention, is a conventional PID regulator which performs a feedback control loop as follows. Regulator 40 takes as input from a treatment planning system a given set-point $I_C$ of the particle beam current intensity and computes a corresponding set-point value $SV_D$ for the high frequency power generator 30 which applies a voltage amplitude $V_D$ to the Dee electrodes in order to deliver the particle beam with a current intensity $I_M$. The beam intensity $I_M$ is then measured by means of an ionization chamber 31 and is converted to a signal $I'_M$. The latter is finally compared to the set-point $I_C$, in order to obtain an error signal (if any) which is further processed by regulator 40 in order to obtain the correct value of $I_M$.

Figure 3:
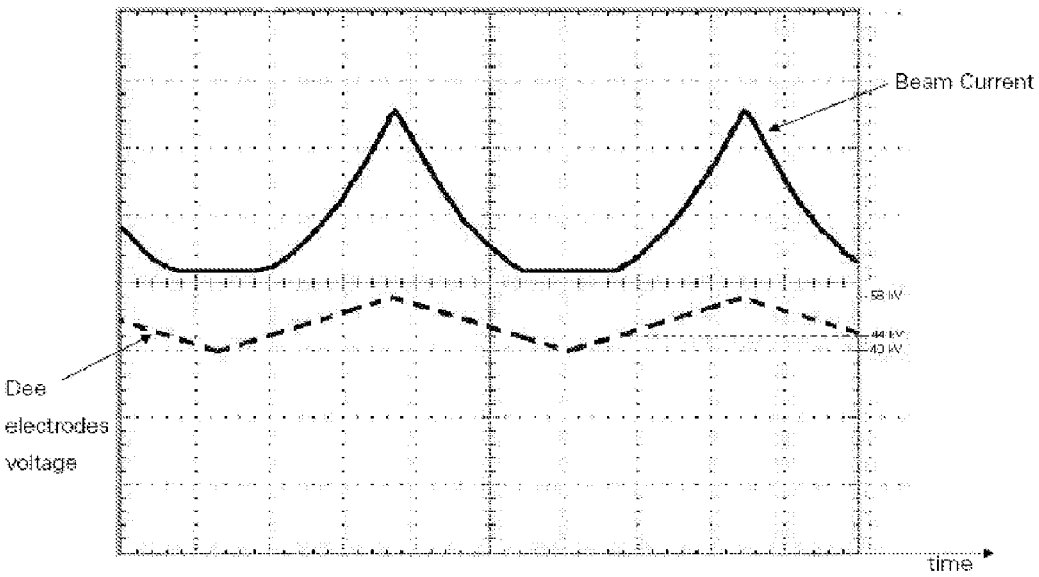
FIG. 3 shows some results of measurements performed on a particle accelerator according to the present invention.

FIG. 3 shows some results obtained from measurements wherein the Dee electrodes voltage amplitude is continuously varied and regulated with a PID regulator. In this simulation the PID regulator was used for the central region of a cyclotron with the following no limiting features:

B=13250 Hz;

Fc=6625 Hz;

Q=8000;

F0=106 Mhz.

Where B is the bandwidth; Fc is the frequency cut-off; Q is the quality factor; and F0 is the resonant frequency of the central region of said cyclotron. The Dee electrodes voltage amplitude has been varied with a triangular waveform continuously oscillating between 40 kV (minimum voltage value) and 56 kV (maximum voltage value). One can easily see that the beam current (upper solid line curve) reaches the cut-off value when the Dee electrodes voltage amplitude (lower dashed line curve) is around 44 kV, and consequently no dark current is produced by the particle accelerator.

According to the present invention, it is possible to modulate the particle beam current intensity exiting a cyclotron by varying the amplitude of the voltage applied to Dee electrodes, instead of varying the ion source arc current.

Moreover, all unwanted particles that are extracted from the ion source can be easily stopped by means of collimating means provided in the central region of the cyclotron.

Furthermore, with the present invention is possible to allow the ion source working in a stable and optimum working point.

The invention claimed is:

1. A circular particle accelerator for generating a beam of charged particles comprising:

an ion source configured to generate the charged particles;

accelerating electrodes separated from each other by gaps;

a generator configured to apply an alternating voltage to the accelerating electrodes to accelerate the charged particles in an electric field in the gaps and to form a beam current, the generator comprising a control input configured for receiving a set-point value for the amplitude of the alternating voltage applied to the accelerating electrodes, wherein different set point values result in different amounts of energy gained by the charged particles in the electric field in the gaps; and a regulator connected with the generator and configured to provide at least one set point value to the control input where the beam current is cut-off and dark current is not produced by the circular particle accelerator.

2. The circular particle accelerator of claim 1 wherein the circular particle accelerator is a cyclotron having an internal ion source.

3. The circular particle accelerator of claim 1 wherein the circular particle accelerator is a cyclotron having an external ion source.

4. The circular particle accelerator according to claim 1, wherein the circular particle accelerator is configured to provide a stabilized ion source arc current.

5. A circular particle accelerator for generating a beam of charged particles comprising:

an ion source configured to generate the charged particles;

accelerating electrodes separated from each other by gaps;

a generator configured to apply an alternating voltage to the accelerating electrodes to accelerate the charged particles in an electric field in the gaps and form a beam current; and a regulator connected with the generator, the regulator configured to control the amplitude of the alternating voltage applied to the accelerating electrodes, the regulator configured to cut-off the beam current by effecting the generator to apply to the accelerating electrodes a voltage with an amplitude below a threshold voltage where the beam current is cut-off and dark current is not produced by the circular particle accelerator.

6. The circular particle accelerator of claim 5 wherein the circular particle accelerator is a cyclotron having an internal ion source.

7. The circular particle accelerator of claim 5 wherein the circular particle accelerator is a cyclotron having an external ion source.

8. The circular particle accelerator according to claim 5, wherein the regulator is configured to modulate the amplitude of the alternating voltage applied to the accelerating electrodes between a maximum value, which is higher than the threshold value, and a minimum value, which is lower than the threshold value, so that when the voltage amplitude is lower than the threshold value, the beam current is cut-off and dark current is not produced by the circular particle accelerator.

9. The circular particle accelerator according to claim 8, wherein the circular particle accelerator is configured to effect a stabilized ion source arc current from the ion source during modulation of the amplitude of the alternating voltage applied to the accelerating electrodes.

10. A method for cutting-off beam current in a circular particle accelerator, the method comprising:

generating charged particles from an ion source;

accelerating the charged particles by applying with a generator an alternating voltage to accelerating electrodes in the circular particle accelerator to accelerate the charged particles in an electric field in gaps between the accelerating electrodes and to produce the beam current, wherein different voltage amplitudes result in different amounts of energy gained by the charged particles in the electric field in the gaps; and cutting-off the beam current by reducing the amplitude of the alternating voltage applied to the accelerating electrodes below a threshold value, where dark current is not produced by the circular particle accelerator.

11. The method according to claim 10, wherein the amplitude of the alternating voltage applied to the accelerating electrodes is modulated between a maximum value, which is higher than the threshold value, and a minimum value, which is lower than the threshold value, so that when the voltage amplitude is lower than the threshold value, beam current is cut-off and dark current is not produced by the circular particle accelerator.

12. The method according to claim 10, wherein the ion source arc current from the ion source is stabilized to a predetermined value during modulation of the amplitude of the alternating voltage applied to the accelerating electrodes.

13. The circular particle accelerator according to claim 10 wherein the collimator is located in a central region of the particle accelerator.

14. The circular particle accelerator according to claim 10, wherein the circular particle accelerator is configured to effect a stabilized ion source arc current from the ion source with a predetermined value.

15. The circular particle accelerator according to claim 10, wherein the circular particle accelerator is a cyclotron having an internal ion source.

16. The circular particle accelerator according to claim 10, wherein the circular particle accelerator is a cyclotron having an external ion source.

17. A circular particle accelerator for generating a beam of charged particles comprising:

an ion source configured to generate the charged particles;

accelerating electrodes separated from each other by gaps;

a generator configured to apply an alternating voltage to the accelerating electrodes to accelerate the charged particles in an electric field in the gaps and to form a beam current;

a collimator configured for stopping charged particles having an orbit radius less than or equal to a critical orbit radius; and a regulator connected with the generator, the regulator configured to control an amplitude of the alternating voltage applied to the accelerating electrodes, wherein different voltage amplitudes result in different orbit radii of the charged particles, and a voltage amplitude below a threshold value results in an orbit radius less than said critical orbit radius, the regulator configured to cut-off the beam current by effecting the generator to apply to the accelerating electrodes a voltage with an amplitude below said threshold value.

18. A method for cutting-off a beam current in a circular particle accelerator, the circular particle accelerator comprising:

an ion source configured to generate charged particles;

accelerating electrodes separated from each other by gaps;

a generator configured to apply an alternating voltage to the accelerating electrodes configured to accelerate the charged particle beam in an electric field in the gaps and to form the beam current;

a collimator configured for stopping charged particles having an orbit radius less than or equal to a critical orbit radius; and a regulator connected with the generator, the regulator configured to modulate an amplitude of the alternating voltage applied to the accelerating electrodes, wherein different voltage amplitudes result in different orbit radii of the charged particles, and the circular particle accelerator is configured so that a voltage amplitude below a threshold value results in an orbit radius less than said critical orbit radius;

wherein the beam current is cut-off by applying to the accelerating electrodes a voltage with an amplitude below said threshold value.

19. The method according to claim 18, wherein the collimator is located in a central region of the particle accelerator.

20. The method according to claim 18, wherein the ion source generates a stabilized ion source arc current with a predetermined value.

21. The method according to claim 18, wherein the circular particle accelerator is a cyclotron having an internal ion source.

22. The method according to claim 18, wherein the circular particle accelerator is a cyclotron having an external ion source.

23. The method according to claim 18, wherein the beam current is measured and the regulator modulates the amplitude of the alternating voltage applied to the accelerating electrodes as a function of a given set-point value (Ic) of the beam current.

24. The method according to claim 18, wherein the amplitude of the alternating voltage applied to the accelerating electrodes is modulated between a maximum value, which is higher than the threshold value, and a minimum value, which is lower than the threshold value, so that when the voltage amplitude is lower than the threshold value, the beam current is cut-off and dark current is not produced by the circular particle accelerator.

25. A circular particle accelerator for generating a beam of charged particles comprising:

an ion source configured to generate the charged particles;

accelerating electrodes separated from each other by gaps;

a generator configured to apply an alternating voltage to the accelerating electrodes to accelerate the charged particles in an electric field in the gaps and to form a beam current; and a regulator connected with the generator, the regulator configured to vary an amplitude of the alternating voltage applied to the accelerating electrodes, wherein different voltage amplitudes result in effecting at least one different set point value where dark current is not produced by the accelerator.

26. The circular particle accelerator according to claim 25, wherein the circular particle accelerator is configured to effect a stabilized ion source arc current from the ion source during varying of the amplitude of the alternating voltage applied to the accelerating electrodes.

* * * * *